US006441794B1

(12) United States Patent
Tang et al.

(10) Patent No.: US 6,441,794 B1
(45) Date of Patent: Aug. 27, 2002

(54) DUAL FUNCTION SUBREFLECTOR FOR COMMUNICATION SATELLITE ANTENNA

(75) Inventors: Minh Tang, San Jose; Terry M. Smith, La Honda, both of CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/928,597

(22) Filed: Aug. 13, 2001

(51) Int. Cl.[7] ..... H01Q 13/00
(52) U.S. Cl. ..... 343/781 CA; 343/DIG. 2
(58) Field of Search ..... 343/781 R, 781 CA, 343/DIG. 2, 772, 781, 781 P, 840

(56) References Cited

U.S. PATENT DOCUMENTS 4,618,867 A * 10/1986 Gans ..... 343/781 P
5,136,294 A * 8/1992 Iwata ..... 343/781 P
5,485,168 A * 1/1996 Parekh ..... 343/761
5,977,923 A * 11/1999 Contu et al. ..... 343/761
6,198,455 B1 * 3/2001 Luh ..... 343/781 CA

* cited by examiner

*Primary Examiner*—Don Wong
*Assistant Examiner*—Hoang Nguyen
(74) *Attorney, Agent, or Firm*—Kenneth W. Float

(57) ABSTRACT

A satellite-based antenna system that employs an improved dual function subreflector. An exemplary antenna system comprises a flat plate dual function subreflector and a subreflector positioning mechanism that selectively positions the subreflector at predetermined positions corresponding to two or more operational positions of the satellite. A plurality of feed arrays couple energy to and from the subreflector, and a main reflector generates beams for desired coverage areas. The present invention provides optimum performance from a dual reflector antenna when operating in two or more different satellite positions, with no compromise to the performance for either mode of operation.

7 Claims, 1 Drawing Sheet

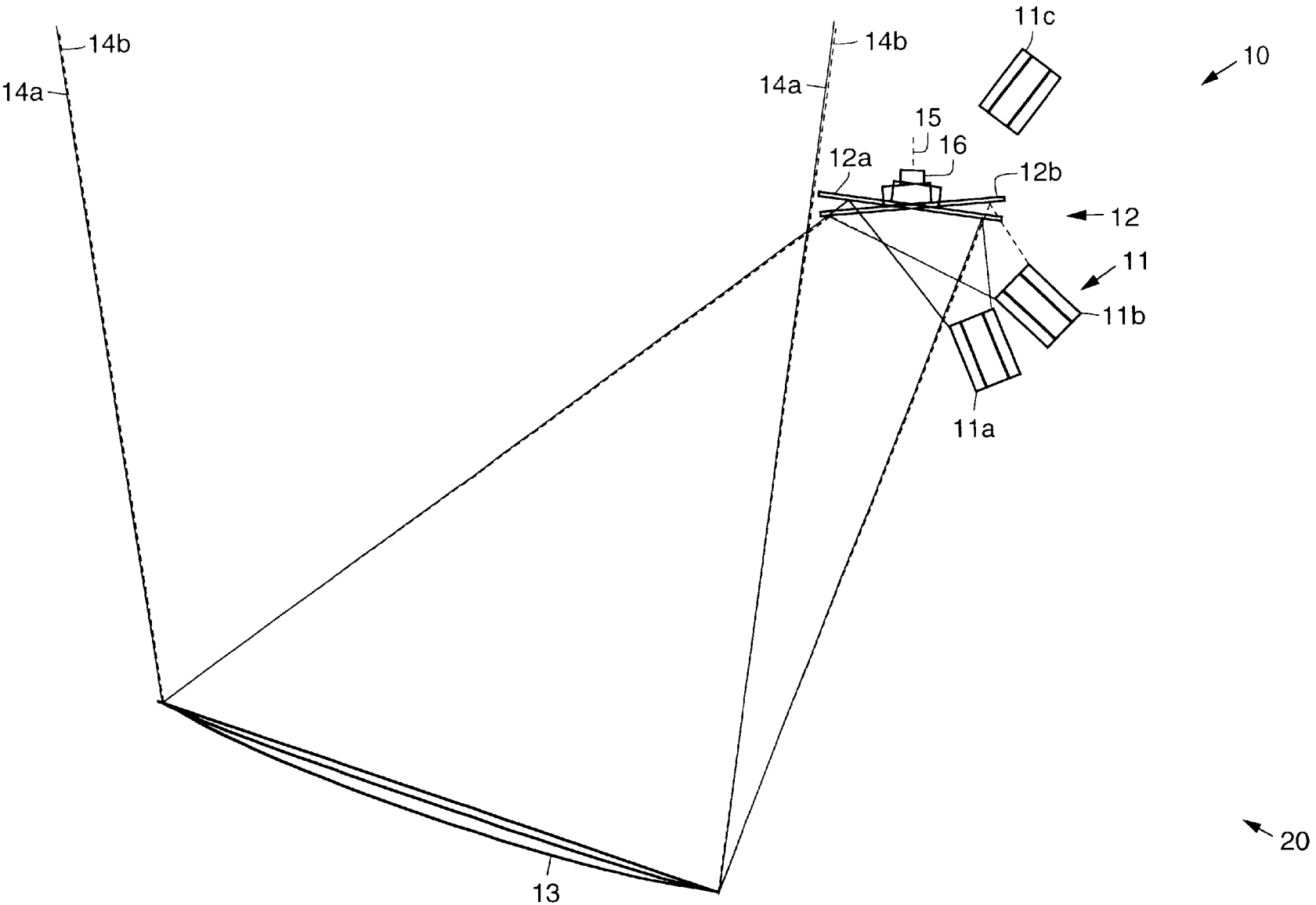
10
20
11c
12
11
11b
12b
11a
15
16
14b
12a
14a
13
14b
14a

DUAL FUNCTION SUBREFLECTOR FOR COMMUNICATION SATELLITE ANTENNA

BACKGROUND

The present invention relates generally to antenna systems, and more particularly. to a communication satellite antenna system having an improved dual function subreflector.

Conventional dual reflector antenna systems, and in particular those that are used in satellite-based communication antenna systems, operate with optimum performance for beams that cover a desired coverage areas as viewed from one specific orbital position. Operation of the satellite in more than one orbital position has resulted in performance reduction due to the fact that the antenna system is a compromised between orbital positions.

It is an objective of the present invention to overcome this limitation of such conventional dual reflector antenna systems. It is also an objective of the present invention to provide for a communication satellite antenna system having an improved dual function subreflector.

SUMMARY OF THE INVENTION

The present invention provides for an improved satellite-based antenna system that employs an improved dual function subreflector. The present invention provides optimum performance from a dual reflector antenna when operating in two or more different satellite positions, with no compromise to the performance for either mode of operation.

An exemplary antenna system comprises a flat plate dual function subreflector and a subreflector positioning mechanism that selectively positions the subreflector at predetermined positions corresponding to two or more operational positions of the satellite. A plurality of feed arrays couple energy to and from the subreflector, and a main reflector generates beams for desired coverage areas.

In a dual reflector antenna system, the selected orientation of the flat plate subreflector maps the equivalent focal point of the main reflector to a position within a selected feed array. The size and position of each feed radiator in a selected feed array is optimized to form one or more beams generated from the antenna system for coverage areas as viewed from the selected orbital position of the satellite.

When using the present antenna system, the same coverage area may be provided from different orbital positions of the satellite. In addition, two or more totally different and independent coverage areas may be provided from the satellite that parks on the same or different orbital locations.

The antenna system thus comprises a flat plate subreflector that is oriented to "steer" the focal point of a main reflector so that different feed arrays can b used to provide a set of beams for operation from the satellite in different orbital positions. The performance of the antenna system for each orbital position is individually optimized. independent of the other feed array(s).

An advantage of using this configuration for a communication antenna is that the optimum performance for each satellite orbital position of operation results in the highest antenna gain achievable and results in the highest Effective (Equivalent) Isotropic Radiated Power (EIRP) and gain-to-system noise temperature (G/T) for the communication system. The sidelobe structure of each beam is also optimum and results in reduced interference.

BRIEF DESCRIPTION OF THE DRAWINGS

The various features and advantages of the present invention may be more readily understood with reference to the following detailed description taken in conjunction with the accompanying drawing FIGURE, which illustrates an antenna system employing an exemplary dual function subreflector in accordance with the principles of the present invention.

DETAILED DESCRIPTION

Referring to the sole drawing FIGURE, it illustrates an antenna system 10 employing an exemplary dual function subreflector 12 in accordance with the principles of the present invention. The drawing figure illustrates the con figuration of the antenna system 10 which provides optimized antenna performance for two or more operational positions of a communication satellite 20 (generally designated).

The antenna system 10 comprises a flat plate dual function subreflector 12, a subreflector positioning mechanism 16 coupled to the subreflector 12, a plurality of feed arrays 11 (shown as first and second feed arrays 11*a*, 11*b*), and a main reflector 13. The plurality of feed arrays 11 couple energy to and from the subreflector 12. The antenna system 10 produces a plurality of beams 14*a*, 14*b* (shown with solid and dashed lines) that generate desired coverage beams 14*a*, 14*b* on the Earth.

The flat plate dual function subreflector 12 is moveable or rotatable around a gimbal axis 15 of the subreflector positioning mechanism 16 so that it may be positioned or oriented at a plurality of desired positions that are aligned with respect to a selected one of the plurality of feed arrays 11*a*, 11*b*. Two positions are illustrated in the drawing figure and are identified as subreflectors 12*a*, 12*b*. The virtual position of the plurality of feed arrays 11*a*, 11*b* is illustrated as feed array 11*c* located behind the subreflector 12.

The basic principle of the present invention is to select the orientation of the flat plate subreflector 11 to position the focal point of the main reflector 13 at a position within a selected feed array 11*a*, 11*b*. This allows the size and position of each feed radiator in that selected feed array 11*a*. 11*b* to be optimized for a beam 14*a*. 141*b* generated from the antenna system 10, for coverage regions as viewed from that orbital position of the satellite 20.

When a different orbital position of the satellite 20 is used, the subreflector 12 is reorientation or repositioned (say from 12*a* to 12*b*) and transponder outputs are switched to a different feed array 11. The focal point of the main reflector 13 is aimed at a point within the newly selected feed array 11. This new feed array 11 has feed elemental radiators that have their size and positions optimized for beams 14*a*. 14*b* aimed to the coverage areas as viewed from the new orbital position of the satellite 20.

It is not necessary that the desired coverage areas are the same for the two (or more) operating orbital positions of the satellite 20. A natural extension of the concepts of the present invention is to provide two or more totally different and independent coverage areas from the same or different orbital positions of the satellite 20.

Thus, communication satellite antenna systems having an improved dual function subreflector have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An antenna system for use on a satellite, comprising:

a flat plate dual function subreflector;

a subreflector positioning mechanism coupled to the subreflector for selectively positioning the subreflector at predetermined positions corresponding to two or more operational positions of the satellite;

a plurality of feed arrays that couple energy to and from the subreflector; and a main reflector.

2. The antenna system recited in claim 1 wherein the selected orientation of the flat plate subreflector positions the local point of the main reflector at a position within a selected feed array.

3. The antenna system recited in claim 1 wherein the size and position of each feed radiator in a selected feed array is optimized for a beam generated from the antenna a system for coverage areas as viewed from the selected orbital position of the satellite.

4. The antenna system recited in claim 3 wherein the desired coverage areas are the same for the two or more operating orbital positions of the satellite.

5. The antenna system recited in claim 3 wherein the desired coverage areas are different for the two or more operating orbital positions of the satellite.

6. The antenna system recited in claim 3 wherein the two or more operational positions of the satellite are different and wherein desired coverage areas are different and independent.

7. The antenna system recited in claim 1 wherein the two or more operational positions of the satellite are the same and wherein desired coverage areas are different and independent.

* * * * *